United States Patent [19]

Bondarenko et al.

[11] 4,418,741

[45] Dec. 6, 1983

[54] METHOD OF CONTROLLING RELATIVE MOVEMENT BETWEEN AN INGOT AND A MOLD

[76] Inventors: Oleg P. Bondarenko, ulitsa Kreschatik, 15, kv. 36; Igor A. Genis, ulitsa Nischinskogo, 5, kv. 39; Vitaly M. Baglai, bulvar Lesi Ukrainki, 2, kv. 51; Boris B. Fedorovsky, ulitsa Mechnikova, 7a, kv. 26; Boris I. Medovar, ulitsa Anri Barbjusa, 22/26, kv. 109; Grigory A. Timashov, bulvar Davydova, 7, kv. 143; Vasily I. Us, ulitsa Saxaganskogo, 58, kv. 12; Georgy S. Pavlichenko, ulitsa B. Kitaevskaya, 61a, kv. 18; Igor G. Sidorenko, ulitsa Bereznyakovskaya, 24, kv. 104, all of Kiev, U.S.S.R.

[21] Appl. No.: 97,216

[22] Filed: Nov. 26, 1979

[51] Int. Cl.[3] ..... B22D 11/16; B22D 27/02

[52] U.S. Cl. ..... 164/454; 164/469; 164/470; 164/495; 164/508; 164/515; 164/413

[58] Field of Search ..... 164/4, 52, 154, 413, 164/252, 454, 469, 470, 495, 497, 508, 509, 514, 515; 13/9

[56] References Cited

U.S. PATENT DOCUMENTS

| | | | |
|---|---|---|---|
| 2,972,041 | 2/1961 | Mosny et al. | 164/252 X |
| 4,000,361 | 12/1976 | Bondarenko et al. | 164/154 X |

FOREIGN PATENT DOCUMENTS

| | | | |
|---|---|---|---|
| 1598147 | 8/1970 | France | 164/52 |
| 1326091 | 8/1973 | United Kingdom | 164/154 |
| 1380467 | 1/1975 | United Kingdom | 164/52 |
| 1480216 | of 0000 | United Kingdom . | |
| 371807 | of 1972 | U.S.S.R. . | |

OTHER PUBLICATIONS

Bondarenko, O. P., "The Programming and Automatic Control of Electroslag Remelting", pp. 76–82, 12/1970.

Apparatus for Thermometric Control of Liquid Slag and Molten Metal Levels in Installations of Special Electrometallurgy by Gerastchenko, Palti, Taranenko (Information Letter No. 55), 1975.

*Primary Examiner*—Gus T. Hampilos

*Attorney, Agent, or Firm*—Lilling & Greenspan

[57] ABSTRACT

A method of controlling relative movement between an ingot and a mold consists of monitoring the level of the metal pool in the mold by measuring the voltage between the ingot and a mold section disposed above the metal pool, in contact with the bath of molten slag and insulated electrically from the ingot and from the ingot-forming mold section; comparing an instantaneous value of said voltage with a predetermined value and varying the relative speed of the ingot and the mold depending on a signal proportional to the difference between the instantaneous and the predetermined values of said voltage so that the predetermined level of the metal pool is restored.

9 Claims, 6 Drawing Figures

METHOD OF CONTROLLING RELATIVE MOVEMENT BETWEEN AN INGOT AND A MOLD

BACKGROUND OF THE INVENTION

1. Field of the Invention

The invention relates to the art of electrometallurgy and more particularly to a method of controlling relative movement between an ingot and a mold, as well as a mold for carrying out the method in the process of electroslag melting.

2. Description of the Prior Art

Methods of controlling the relative movement between an ingot and a mold in electroslag melting are presently widely known in the pertinent art, wherein an ingot and a mold are relatively moved by varying their speeds in response to variations in the level of the metal pool. The level of the metal pool is monitored by sensors of the heat, induction, photoelectric, and other types, installed in the mold wall.

Among these is a method of controlling relative movement between an ingot and a mold as disclosed in USSR Inventor's Certificate No. 371,807, Int. Cl.[2] C21C 5/56, published Dec. 6, 1972, wherein the level of the metal pool is monitored by the metal temperature.

The temperature is determined by measuring the intensity of the radiation from the ingot surface by a photoelectric sensor installed in the mandrel. In response to variations in the temperature of the ingot surface at the sighting zone of the photoelectric sensor, which variations are indicative of the poor level variations, the relative speed of the ingot and the mold is correspondingly varied so that a predetermined level of the metal pool is restored.

However, instability of the sensor signal, caused by a different in thickness of the slag skin on the inner surface of the hollow ingot varied with the slag used in the melting process, prevails, which leads to an appreciable reduction in the accuracy of monitoring and hence the quality of the ingot produced. Moreover, thermal protection for the photoelectric sensor against high temperature and mechanical damage is required, which results in a rather complicated construction of the mandrel and a lower dependability of the sensor and the control system as a whole. Special-purpose protective filters, which are indispensable to eliminate pickups of the furnace working current in the weak-current output circuits of the photoelectric sensor, also greatly complicate the equipment used to practice the method.

From the above it is to be noted that the prior art method of controlling relative movement between an ingot and a mold is not useful to invariably hold the melt level, and, hence, to produce high-quality ingots because of a low accuracy in pool level control.

The mold, which is controlled in its movement with respect to the ingot as described above (USSR Inventor's Certificate No. 371,807, Int. Cl[2] C21C 5/56), has walls which, in combination with a base plate and mandrel, define a melting space for producing hollow ingots.

Known in the prior art is a mold disclosed in British Pat. No. 1,480,216 published Oct. 5,1973. This mold has walls which, in combination with a base plate, define a melting space for producing solid ingots. An upper mold section is electrically insulated from the ingot and from the lower mold section along the perimeter thereof, disposed above the level of the metal pool and in contact with the bath of molten slag.

The molds of the type disclosed are rather complicated structures to produce and to use since thermal protection is required for electric insulation from the action of the molten slag and a reliable fluid seal is of importance at the junction of the upper and lower mold sections along the inner perimeter thereof.

SUMMARY OF THE INVENTION

The principal object of the invention is to provide a method of controlling the relative movement between an ingot and a mold as well as the mold therefor, which assure high quality of the ingots produced, through higher accuracy of the pool level control with simpler apparatus therefor.

Another equally important object of the invention is to provide a more dependable system for controlling relative movement between an ingot and a mold.

These and other objects and advantages of the invention are attained by providing a method of controlling the relative movement between an ingot and a mold, which consists of monitoring the level of the metal pool and subsequently varying the relative speed of the ingot and the mold in response to variations in the level of the metal pool so that a predetermined level thereof is restored. According to the invention, the level of the metal pool in the mold is monitored by measuring the voltage between the ingot and a mold section electrically insulated from the ingot and from the mold-forming mold section, disposed above the metal pool level and in contact with the bath of molten slag. The result of such measurement is then compared with a predetermined value. Depending on the difference between the instantaneous and the predetermined values of said voltage, the relative speed of the ingot and the mold is correspondingly changed.

The above described method of controlling the relative movement between an ingot and a mold makes it possible to enhance the accuracy of monitoring by utilizing simpler equipment, and hence produce ingots of higher quality inasmuch as control of relative movement between an ingot and a mold is effected from the voltage across the electrically insulated mold section and the ingot which voltage is measured directly at the mold.

In the process of producing hollow ingots in molds provided with a mandrel the voltage is measured between the ingot and the mandrel head portion, serving in this case as said electrically insulated mold section.

In the process of producing solid ingots in built-up molds the voltage is measured between the ingot and the upper mold section, which section is acting as said electrically insulated section in such molds.

Said electrically insulated section of the mold is preferably constructed as a conducting insertion piece installed in the mold wall disposed above the metal pool level and in contact with the bath of molten slag. This arrangement makes for a simpler and more reliable mold for practicing this method.

When making use of this type of the mold, the voltage is measured between the current-conducting insertion piece, in the mold wall, and the ingot.

The highest accuracy in determining the pool level, while using molds from all of these above disclosed, is achieved if the voltage between the consumable electrode and the ingot is measured concurrently with the measurement of the voltage between the electrically insulated mold section and the ingot. Then the ratio of the voltage between the electrically insulated mold section and the ingot to the voltage between the consumable electrode and the ingot is determined and the same ratio is subsequently compared with a predetermined value.

This provides for exlusion of influence of variations in the melting process and electrical parameters on the magnitude of said signal.

The above ratio is preferred in the range of 0.1 to 0.8.

It is appropriate, as a modification of the method, to measure the operating current concurrently with the measurement of the voltage between the insulated mold section and the ingot, to determine the ratio of the voltage between the mold and the insulated mold section to the operating current, and then to compare this ratio against a predetermined value. This makes the method simpler to practice since there is no need for auxiliaries to measure the voltage at the bath of molten slag in close proximity to the molten slag similar to that in the previous modification of the method.

The above ratio is preferably maintained in the range of $(0.2 \text{ to } 2.0)\times 10^{-3}\Omega$.

BRIEF DESCRIPTION OF THE DRAWINGS

The invention will be now explained with reference to specific embodiments thereof which are represented in the accompanying drawings, wherein.

DESCRIPTION OF THE INVENTION

Figure 2:
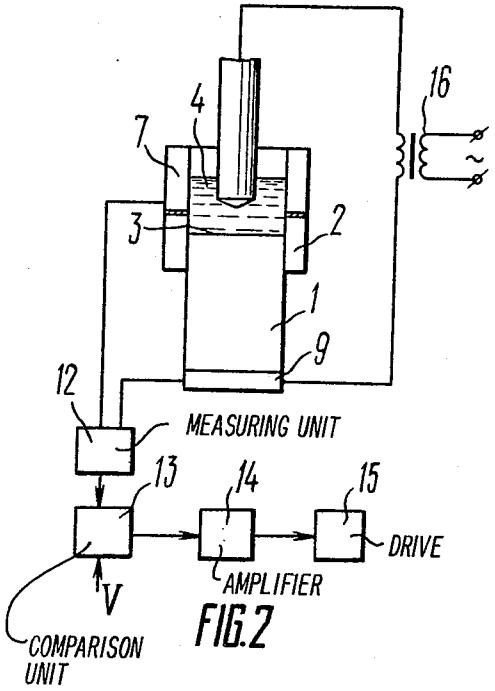
FIG. 2 is a schematic diagram of a modified arrangement to effect control of relative movement between an ingot and a built-up mold.

A method of controlling the relative movement between an ingot 1 and a mold 2 (FIGS. 1, 2 and 4), a portion or section of which being electrically insulated from the ingot 1 and the ingot-forming portion or section of the mold 2 being disposed above the level of the metal pool 3 and in contact with the bath 4 of molten slag, includes monitoring the level of the metal pool 3 in the mold 2 and subsequently varying the relative speed of the mold 2 and the ingot 1 with variations in the level of the metal pool 3 so that a predetermined level thereof is restored. The level of the metal pool 3 is monitored by measuring the voltage between the electrically insulated section of the mold 2 and the ingot 1; then the same voltage is compared with a predetermined value and, when a deviation or error signal ensues, the speed of the mold 2 and the ingot 1 is correspondingly varied. When the voltage decreases, a signal for an increase in the speed is generated, and, when it increases, a signal for a decrease in the speed of the ingot 1 and the mold 2 is generated, thus approximation of said voltage to that of a predetermined value, which is representative of a predetermined level of the metal pool, is effected.

In producing hollow ingots 1 (FIG. 1) in a mold 2 provided with a mandrel 5 having a head portion 6 as an electrically insulated mold portion the voltage is measured between the mandrel head portion 6 and the ingot 1. Now the process of controlling relative movement between the ingot 1 and the mold 2 is done similarly to that described above.

In producing solid ingots 1 in built-up molds 2 (FIG. 2), wherein an upper section 7 is an electrically insulated mold portion, the voltage is measured between the upper section 7 of the mold 2 and the ingot 1, then compared against a predetermined value and, when there is an error signal, the relative speed of the ingot 1 and the mold 2 is varied as hereinabove described.

Figure 3:
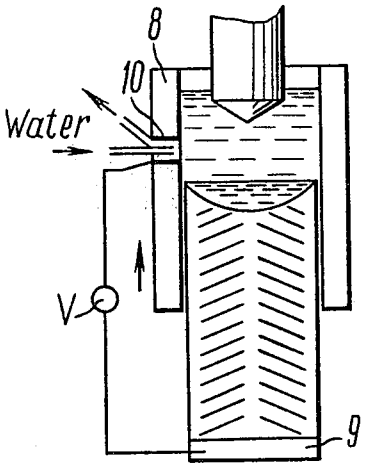
FIG. 3 is a diagrammatic representation of a mold of the invention, provided with an electrically insulated conducting insertion piece.

However, the built-up molds present difficulties in construction and service because they require thermal protection of the insulation from the action of slag and an adequate fluid seal at the junction of both the upper and the lower mold sections along the joint perimeter. A simpler mold design is shown in FIG. 3, wherein the mold has walls 8, in combination with a base plate 9, defining a melting space for producing solid ingots, and an insertion piece 10 in the same walls serving as an electrically insulated portion. The insertion piece 10 may have a cylindrical, prismatic or some other form. Its dimensions are limited mainly as to height by the depth of the slag bath.

In this case the method of controlling relative movement between the ingot 1 and the mold 2 (FIG. 4) comprises the step of monitoring the level of the metal pool 3 by measuring the voltage between the conducting insertion piece 10 and the ingot 1, then comparing this voltage value with a predetermined one and when there is an error signal, varying the relative speed of the ingot 1 and the mold 2 so that the predetermined level of the metal pool 3 is restored.

To eliminate the effect of variations in the melting rate and electrical characteristics on the voltage measured while producing hollow as well as solid ingots in each of the molds hereinabove described, it is advisable that the voltage between a consumable electrode 11 (FIG. 5) and the ingot be measured concurrently with the measurement of the voltage between the electrically insulated mold portion and the mold, and the ratio of the voltage between the electrically insulated portion of the mold 2 and the ingot 1 to the voltage between the consumable electrode 11 and the ingot 1 be determined. This ratio is then compared with a predetermined one, and should be maintained in the range of 0.1 to 0.8. If this ratio is less than 0.1, sealing of the electrically insulated portion of the mold 2 with the metal will occur and there will be a loss of the control signal. On the other hand, if this ratio is higher than 0.8, then due to the electrically insulated mold portion being in close proximity to the electrode the control signal will be greatly subjected to the effects of variations in the level of the slag bath 4 and of some other disturbances.

Following the comparison of the instantaneous value of the ratio with that of a predetermined one and when there is an error signal a, corresponding variation in the relative speed of the ingot 1 and the mold 2 is effected so that the predetermined level of the metal pool 3 is restored.

For best results in practicing this modification of the method suitable means capable of contacting the electrode are required to pick up the voltage across the electrode at the slag bath level. For this end a roller rigidly supported by any bracket means may do.

The most suitable modification of the method may be measuring the operating current concurrently with the measurement of the voltage between the electrically insulated portion of the mold 2 and the ingot 1 and determining the ratio of the voltage between the electrically insulated mold portion and the ingot to the operating current. This ratio is then compared with a predetermined value. When there is an error signal or the signal is proportional to a difference between instantaneous and predetermined values, the relative speed of the ingot and the mold is varied so that the predetermined level of the metal pool is restored. It will be understood by those skilled in the art that no auxilliaries for measuring voltage across the electrode are required in this case as has been the case in the previous modification.

The ratio of the voltage between the insulated mold portion and the ingot to the operating current are to be maintained in the range of $(0.2 \text{ to } 20)\times 10^{-3}\Omega$.

This range no less than the previous one is selected for the same reasons. Thus, if this ratio is less than $0.2\times 10^{-3}\Omega$, sealing of the electrically insulated portion of the mold with the metal may occur, which results in the loss of the control signal. On the other hand, if this ratio is higher than $20\times 10^{-3}\Omega$, then due to the electrically insulated mold portion being in close proximity to the electrode the control signal will be greatly subjected to the effects of variations in the level of the slag bath and some other disturbances.

Figure 1:
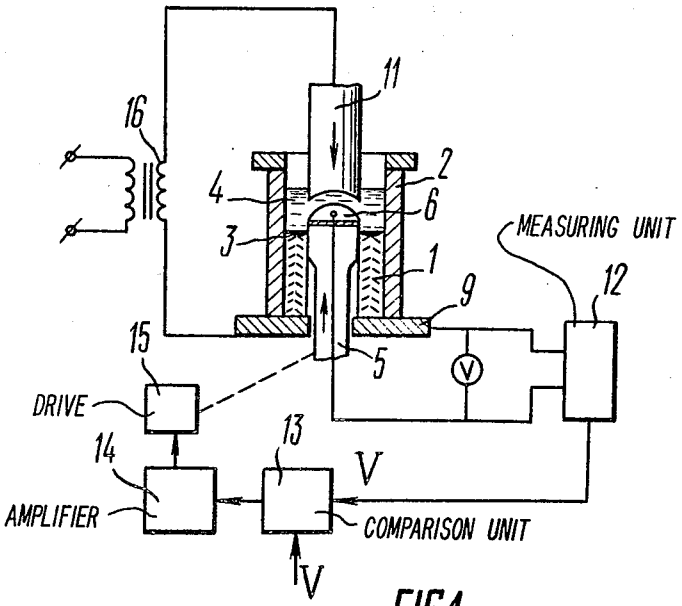
FIG. 1 is a schematic diagram showing an operative arrangement to effect control of relative movement between an ingot and a mold (a mandrel)
Figure 4:
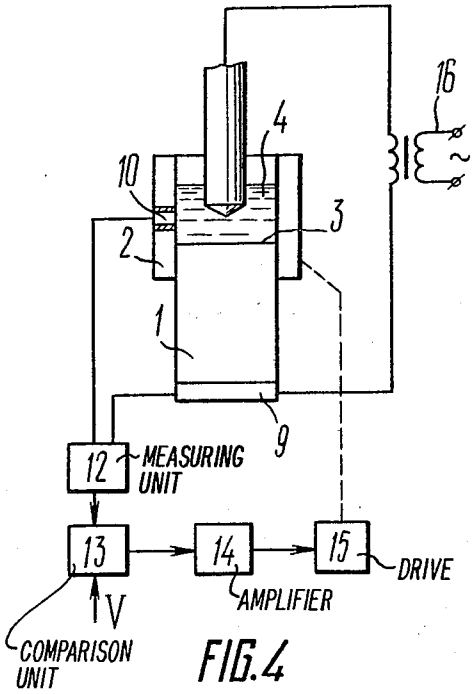
FIG. 4 is a schematic diagram of an arrangement to effect control of relative movement between an ingot and a mold, provided with the electrically insulated conducting insertion piece shown in FIG. 3.

Referring to FIGS. 1, 2 and 4, an arrangement is shown which is effective in controlling relative movement between the ingot 1 and the mold 2. A portion of the mold 2 is electrically insulated from the ingot 1 and from the ingot-forming mold portion, which is disposed above the level of the metal pool 3 and in contact with the slag bath 4. This arrangement includes the following series connected elements: a measuring unit 12 for measuring the voltage between the ingot 1 and the insulated mold portion (head portion 6 of the mandrel 5 in FIG. 1, the upper section 7 of the mold 2 in FIG. 2, and the current-conducting insertion piece 10 in FIGS. 3 and 4); a comparison unit 13 for comparing instantaneous and predetermined voltage values; a reversible amplifier 14; and a drive 15 adapted to effect relative movement between the mold 2 and the ingot 1. FIGS. 1, 2, 4, 5 and 6 show a power source 16 for an electroslag furnace.

Figure 5:
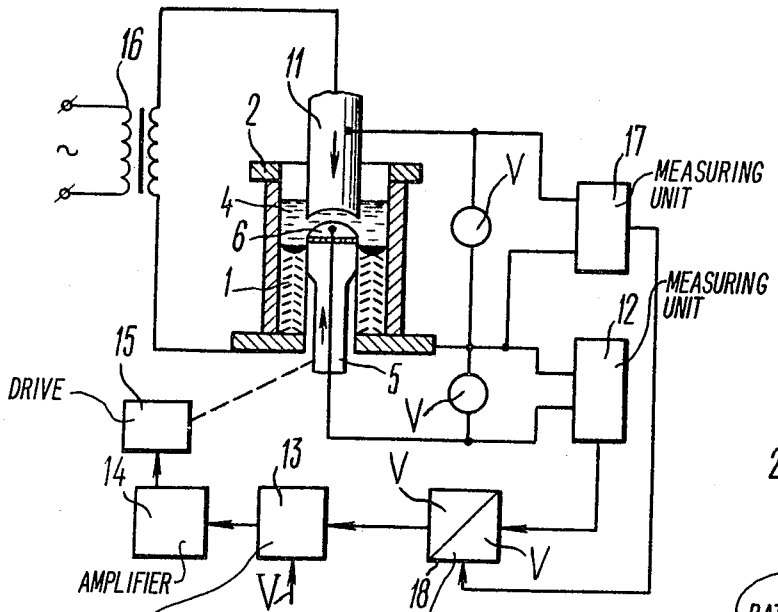
FIG. 5 is a schematic diagram effective in controlling relative movement between an ingot and a mold incorporating a mandrel, and a unit for measuring the voltage between a consumable electrode and an ingot forming part of the diagram.

As shown in FIG. 5 the arrangement for controlling relative movement between the ingot and the mold may further comprise a measuring unit 17 for measuring the voltage between the consumable electrode 11 and the mold 1, and a ratio determination unit 18 for determining the ratio of the voltage between the ingot 1 and the electrically insulated mold portion (elements at 6, 7 and 10 in FIGS. 1, 2 and 3 respectively) to the voltage between the consumable electrode 11 and the ingot 1. The ratio determination unit 18 is connected to the circuit, wherein connected comparison unit 13, the feed-back amplifier 14, the drive 15 and the mold 2. Shown in FIG. 5 is the arrangement for controlling relative movement between the ingot 1 and the mold 2 having movement between the ingot 1 and the mold 2 having the mandrel 5. This arrangement is equally useful for practicing modifications of the method where the built-up mold or the mold provided with the conducting insertion piece are used.

Figure 6:
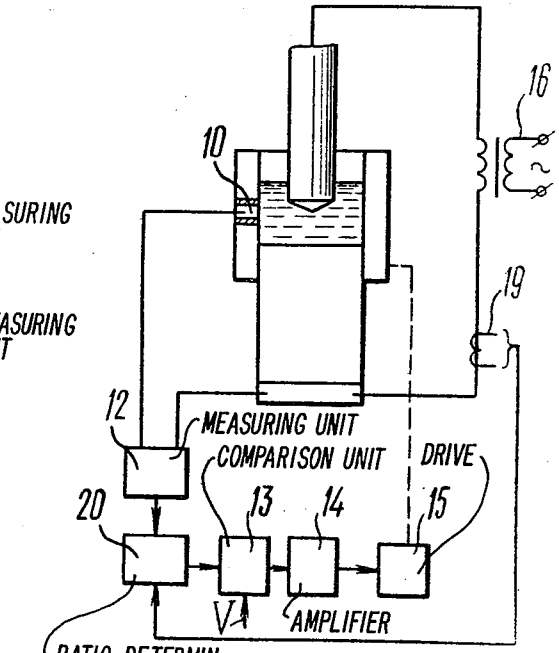
FIG. 6 is a schematic diagram effective in controlling relative movement between an ingot and, a mold, a unit for measuring the operating current flowing between a consumable electrode and an ingot forming part of the diagram.

FIG. 6 shows an improved arrangement for practicing the best modification of the method, which further includes a current measuring unit 19 for measuring the operating current, e.g. a current transformer, a ratio determination unit 20 for determining the ratio of the voltage between the ingot 1 and the electrically insulated mold portion (elements 6, 7 and 10 in FIGS. 1, 2 and 3 respectfully) to the operating current. The ratio determination unit 20 is connected in series with the comparison unit 13, the feed-back amplifier 14, the drive 15, and the mold 2.

The relative movement, when use is made of the above-described arrangement, is controlled as follows.

As the level of the metal pool (in the process of producing hollow and solid ingots) varies, so does the voltage between the electrically insulated mold portion, e.g. the mandrel head portion (FIG. 1), and the ingot 1. Voltage variations are monitored by the measuring unit 12. Then a signal is sent to the comparison unit 13 wherein the voltage signal is compared with a predetermined value. A signal proportional to the difference between the instantaneous and the predetermined values of the voltage is delivered to the drive 15 through the reversible amplifier 14. The drive 15 sets the mold or, as shown in FIG. 1, the inner portion thereof, i.e. the mandrel 5, in motion so that the predetermined level is restored. If the voltage measured is below the predetermined value, the drive 15 moves the mandrel 5 at a higher speed. If the voltage measured is above the predetermined value, the drive 15 moves the mandrel 5 at a correspondingly lower speed. The relative movement between the ingot 1 and the built-up mold 2 or the mold 2 with a conducting insertion piece 10 is controlled in a similar way (FIGS. 2 and 4).

In practicing a modification of the method the measuring unit 17 is used to measure the voltage between the consumable electrode 11 and the ingot 1 (FIG. 5). The output signal from the unit 17 is passed to the unit 18 which determines the ratio of the voltage between the electrically insulated portion of the mold 2 and the ingot 1 to the voltage between the consumable electrode 11 and the ingot 1. Then the signal proportional to this ratio is passed to the unit 13 for comparison with a predetermined value, and amplified in the unit 14. When there is a difference between the instantaneous and the predetermined values, the drive 15 moves the mold, as hereinabove described, so that a predetermined ratio of the voltage in the range of 0.1 to 0.8 is restored as well as the predetermined level of the metal pool 3.

It is a simpler matter however to measure the operating current rather than the voltage between a consumable electrode and an ingot. Therefore the unit 19 monitors the variations of the operating current. The signal from the unit 19 indicating variations in the operating current is passed to the unit 20 for determining the ratio of the voltage between the insulated mold portion to the operating current. A signal is then sent to the unit 13 for comparing the instantaneous value of the ratio with that of the predetermined one and, from there, to the amplifier 14 and then to the drive 15 for moving the mold, as hereinabove described, with said ratio being maintained within the range of $(0.2 \text{ to } 20)\times 10^{-3\Omega}$.

What is claimed is:

1. A method of controlling the relative movement between an ingot and a mold, comprising the steps of:

preparing a molten metal pool covered with a bath of molten slag in a melting space, defined by a base plate and said mold, by melting a consumable electrode;

monitoring the level of said molten metal pool in said mold by measuring the voltage between said ingot and an insulated section of said mold, said insulated section of said mold being disposed above said metal pool and in contact with said bath of molten slag and being electrically insulated from said ingot and an ingot-forming section of said mold;

comparing an instantaneous value of said voltage with a predetermined value of said voltage; and varying the relative speed of the ingot and the mold depending on a signal proportional to the difference between said instantaneous and said predetermined values of said voltage, to restore a predetermined level of said metal pool.

2. A method according to claim 1, wherein said insulated section of said mold includes a head portion of a mandrel, and said voltage is measured between said ingot and said head portion of said mandrel.

3. A method according to claim 1, wherein said insulated section of said mold includes an upper mold section, and said voltage is measured between said ingot and said upper mold section.

4. A method according to claim 1, wherein said insulated section of said mold includes an insertion piece, and said voltage is measured between said ingot and said insertion piece.

5. A method of claim 1, further comprising the steps of measuring voltage between the consumable electrode and the ingot concurrently with the measurement of voltage between said electrically insulated section and the ingot; determining the ratio of the voltage between said electrically insulated mold section and the ingot to the voltage between the consumable electrode and the ingot; and subsequently comparing the instantaneous value of said ratio with a predetermined value.

6. A method of claim 5, wherein the ratio of said voltages is maintained within a range of 0.1 to 0.8.

7. A method of claim 1, further comprising the steps of measuring the operating current concurrently with the measurement of voltage between the ingot and said electrically insulated mold section; determining the ratio of the voltage between the mold and said electrically insulated mold section to the operating current; and comparing the instantaneous value of said ratio with a predetermined value.

8. A method of claim 7 wherein said ratio of the voltage between the ingot and the electrically insulated mold section to the operating current is maintained within a range of $(0.2 \text{ to } 20)\times 10^{-3}\Omega$.

9. A device for manufacturing metal ingots by an electroslag melting process comprising:

a consumable electrode;

a mold comprising vertical walls and a base plate defining a melting space, said consumable electrode melting in said melting space to form a molten metal pool and a molten slag bath, an insulated section of said mold being electrically insulated from said ingot and from an ingot-forming section of said mold, and disposed upstream of said ingot-forming section and above said metal pool and in contact with said molten slag bath;

means associated with said insulated section of said mold for measuring the voltage between said ingot and said insulated section of said mold; and means associated with said mold for changing the relative movement between said ingot and said mold depending on the difference between said voltage and a predetermined value of said voltage.

* * * * *